US006086275A

United States Patent [19]

King

[11] Patent Number: 6,086,275

[45] Date of Patent: Jul. 11, 2000

[54] CLINICAL SCRUB BRUSH DEVICE

[75] Inventor: Allen Paige King, 6100 Crosby Cedar-Bayou Rd., Baytown, Tex. 77521

[73] Assignees: Allen Paige King; Burton G. Manne; Don Smith, all of Baytown, Tex.

[21] Appl. No.: 09/329,581

[22] Filed: Jun. 10, 1999

Related U.S. Application Data

[60] Provisional application No. 60/088,735, Jun. 10, 1998.

[51] Int. Cl.[7] ..... A46B 11/00

[52] U.S. Cl. ..... 401/11; 401/10; 401/134; 15/160; 15/167.3

[58] Field of Search ..... 401/10, 11, 132, 401/133, 134, 268, 282, 7, 6, 9; 15/160, 167.3, 164, 104.04

[56] References Cited

U.S. PATENT DOCUMENTS

| | | | |
|---|---|---|---|
| 1,320,633 | 9/1919 | Minkler | 15/160 |
| 1,728,712 | 9/1929 | Aberle . | |
| 3,066,346 | 12/1962 | Hofsrtra et al. | 401/11 |
| 3,966,335 | 6/1976 | Abramson | 401/10 |
| 4,022,228 | 5/1977 | Ropp et al. . | |
| 4,439,884 | 4/1984 | Giorni . | |
| 4,617,917 | 10/1986 | Miller . | |
| 4,872,235 | 10/1989 | Nielsen . | |
| 5,048,547 | 9/1991 | Walker | 401/10 |
| 5,222,271 | 6/1993 | Eganhouse . | |
| 5,308,406 | 5/1994 | Wallock et al. . | |
| 5,454,131 | 10/1995 | Mackenzie . | |
| 5,471,706 | 12/1995 | Wallock et al. . | |

*Primary Examiner*—David J. Walczak
*Attorney, Agent, or Firm*—James L. Jackson; Mayor, Day, Caldwell & Keeton L.L.P.

[57] ABSTRACT

A clinical scrub brush device having an elongate tubular having an inner peripheral wall surface and having a finger opening at one end which may be flared. Internal bristles project radially from the inner peripheral wall surface for scrubbing of a finger or other object inserted into the internal chamber. A perforate structural member is located at an end of the elongate tubular body and has at least one puncture element. A scrub solution chamber having a quantity of liquid scrub solution is supported at one end of the elongate tubular body and has a movable wall to permit manual pressurization of the scrub solution and has a membrane wall preventing movement of the scrub solution into the internal chamber. The membrane is punctured when forced against the puncture element by scrub solution pressure for releasing scrub solution into the internal chamber. The brush body may define a longitudinal slot along its length permitting objects to be inserted into the internal chamber for scrubbing by the internal bristles.

17 Claims, 2 Drawing Sheets

FIG.2
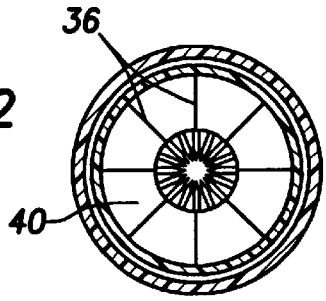
FIG.3
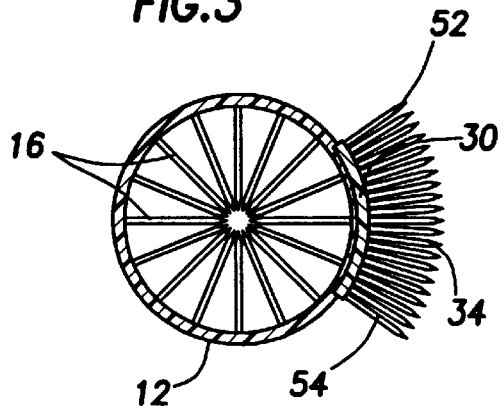
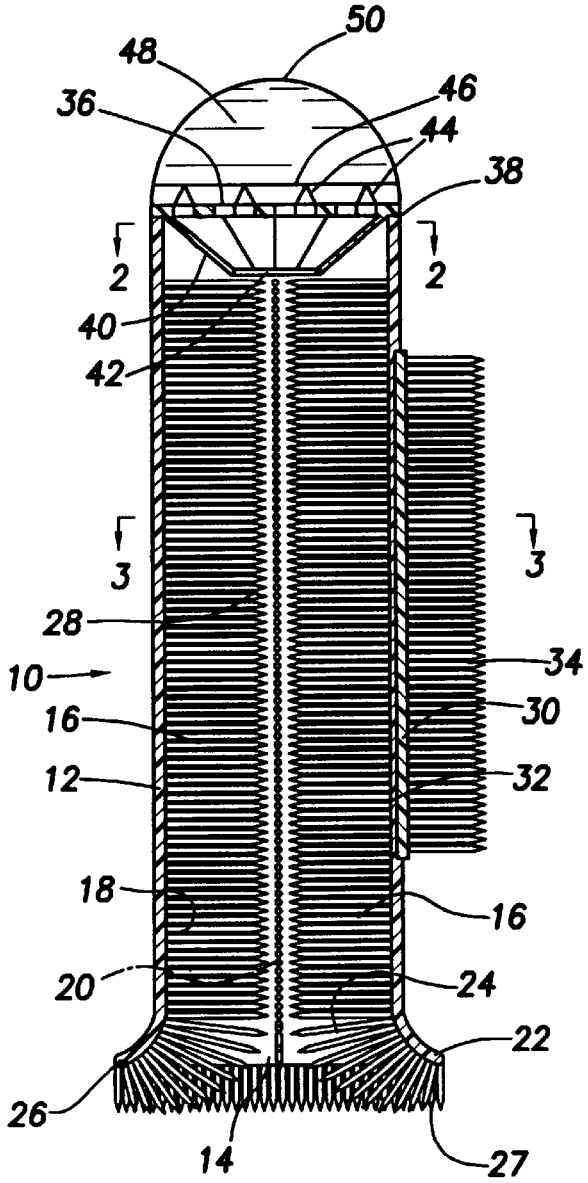
FIG.1

CLINICAL SCRUB BRUSH DEVICE

Applicant hereby claims the benefit of United States Provisional Application Ser. No. 60/088,735 filed on Jun. 10, 1998 by Allen Paige King and entitled "Clinical Scrub Brush Device", which Provisional Application is incorporated herein by reference for all purposes.

FIELD OF THE INVENTION

This invention relates generally to scrub brushes for cleaning the hands of users such as for sterile cleaning in a surgical or medical environment or for non-sterile hand cleaning such as in an industrial or domestic environment. More specifically the invention concerns a scrub brush device of a configuration and having bristles that are arranged for efficient scrubbing of the fingers of users.

SUMMARY OF THE INVENTION

Briefly, the presentation invention constitutes a scrub brush of generally tubular configuration which is designed primarily for scrubbing of the fingers of users whether for the sterile scrubbing that takes place within a surgical theatre or medical facility or for non-sterile scrubbing which is accomplished in an industrial or domestic environment. The brush body has an open end through which the users fingers can be inserted and a closed end which may house a dispenser mechanism for dispensing liquid cleaning agent or medicament or both into an internal receptacle that is defined by the tubular brush body. Though designed primarily for cleaning the fingers and hands of users and the webs of the fingers and hands the invention may have a number of other uses for cleaning specific objects. The scrub brush is of generally tubular configuration defining an internal receptacle and is of a dimension that individual fingers of a user can be inserted into the internal receptacles of the brush. The tubular brush enables scrubbing of the surfaces of the fingers, and for scrubbing beneath and around the fingernails of the user. The tubular brush body is provided with internal bristles which are oriented for the cleaning of specific regions of the fingers. Some bristles are radially inwardly oriented while other bristles extend inwardly and angularly with respect to the internal wall surface of the brush. Additionally, the tubular brush body is flared at its open end and is provided with both internal and external end bristles at the open end which are oriented to enable efficient scrubbing of the webs between the users fingers.

BRIEF DESCRIPTION OF THE DRAWINGS

So that the manner in which the above recited features, advantages and objects of the present invention are attained and can be understood in detail, a description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a sectional view of a brush construction that is designed particularly for clinical application such as for scrubbing of the fingers in a surgical theater;

FIG. 2 is a sectional view taken generally along line 2—2 of FIG. 1 and showing the funnel plate construction of the clinical scrub brush of FIG. 1;

FIG. 3 is a sectional view taken along line 3—3 of FIG. 1 and illustrating the internal and external configuration of the brush construction of FIG. 1 and also showing orientation of internal and external brush bristle elements thereof;

FIG. 4 is an elevational view of a scrub brush having internal bristles therein and external bristles at one end thereof and representing an alternative embodiment of the present invention; and FIG. 5 is a sectional view taken along line 5—5 of FIG. 4 and showing the orientation of internal and external bristle elements thereof.

DETAILED DESCRIPTION OF PREFERRED EMBODIMENT

Figure 5:
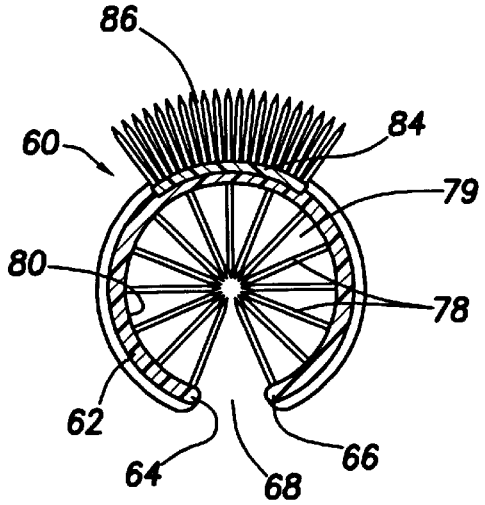

Referring now to the drawings and first to FIG. 1 a brush construction shown generally at 10 is defined by an elongated, generally tubular body 12 which will be typically be formed of a polymer material but which may also be composed of metal, hard rubber, or any other suitable material. The tubular body 12 is typically of circular cross-sectional configuration as is evident particularly in FIGS. 2 and 3 but it may take other suitable forms, such as oval for example, without departing from the spirit and scope of this invention. The tubular body structure 12 will be of sufficient diameter and length to define an internal chamber 28 that serves as a receptacle for the user to insert a finger or thumb through a bottom or end opening 14 thereof. The brush is then rotated and moved linearly with respect to the finger or thumb to develop a scrubbing action to clean the fingers and the webbing where the fingers join the hands of the user.

Within the finger receptacle 28 of the tubular body 12 is provided a multiplicity of bristles 16 that are fixed to the inner peripheral wall surface 18 thereof and project radially inwardly to or near a center-line 20 that extends longitudinally and centrally of the tubular body as shown. Adjacent its open end 14 the tubular body is flared outwardly as shown at 22 so that the end opening 14 is defined by an annular rim that is has a diameter or peripheral dimension that is somewhat greater than the internal diameter of the tubular body 12. An array of angulated internal bristles 24 is mounted to the interior wall structure of the tubular body adjacent the end opening 14 and oriented such that this particular group or array of bristles is angulated in such manner as to be directed toward, and in some cases through, the end opening as shown in FIG. 1. The array of angulated bristles 24 extends along the internal wall structure of the tubular body and along the flared internal wall section to the flared end opening 14. An array of bristles is also mounted to the annular end 26 of the flared end region 22 of the tubular body. Thus, as a user extends a finger or thumb into the internal chamber or finger receptacle of the tubular body the radially extending bristles 16 and the inclined bristles 24 will provide a scrubbing action against the skin of the finger or thumb to thereby provide an efficient cleaning action. The cleaning action is enhanced because of the angulated orientation of the bristles 24. As the finger or thumb is inserted deeper into the tubular body 12 the internally projecting bristles 16 will provide a further cleaning action. Because of the circular cross-sectional configuration of the tubular body and the orientation of the bristle sets 16 and 24, the tubular body can be manually rotated to thereby enhance the cleaning or scrubbing activity of the brush. The circular group of bristles 27 that project from the circular edge 26 of the tubular body will provide an efficient scrubbing activity as the tubular body is rotated against any skin tissue. Thus, the webs between the fingers and the web between the index finger and thumb of the user can be efficiently scrubbed and cleaned by rotating the tubular body when the thumb or finger has been fully inserted into the internal chamber 28 of the body.

The brush construction of FIG. 1 is also designed for scrubbing by means of one or more external multi-row exterior brush bristle sets. As shown at the right side portion of FIGS. 1 and 3 a bristle base pad 30 may be provided along a side portion of the tubular body 12. The bristle base pad 30 may be integrally formed with the structure of the tubular body or, in the alternative, it may be fixed to the tubular body by bonding or by any other suitable means. Typically, the bristle base pad 30 will be located within a corresponding recess 32 that is defined by the wall structure of the tubular body. To the bristle base pad 30 is mounted a multi-row array of exterior bristles 34. Thus, by using the tubular body 12 as a handle, the user can move the brush back and forth to provide a reciprocating scrubbing action against any suitable surface.

Though the brush construction shown in FIGS. 1–3 is particularly designed as a clinical scrub brush for use such as in a surgical theater or medical facility, nevertheless it may have a number of other uses without departing from the spirit and scope of the present invention. The scrub brush structure of FIGS. 1–3, intended for use either as a clinical, disposable brush for cleaning the fingers of users or as a brush for other character of cleaning, such as cleaning of the hands and fingers in the industrial or domestic environment.

It is considered practical to provide a source of scrub solution that can be controllably liberated into the internal chamber 28 to thus enhance the cleaning activity of the bristles, and in some cases, to provide an antiseptic or anti-bacterial characteristic for the purpose of substantially eliminating the presence of bacteria on the hands of the user. One suitable scrub brush for accomplishing supply of scrub solution to the internal chamber 28 may conveniently take the form shown in FIG. 1 wherein a perforate transverse structural member, also referred to as a funnel plate 36 is shown to be mounted across the end 38 of the tubular body 12 so as to provide a perforate structural member through which scrub solution can pass. A funnel element 40 is mounted to the funnel plate 36 and defines a funnel opening 42 of reduced dimension with a centrally located funnel opening so that scrub solution passing through the funnel plate will flow into the central portion of the tubular body for coating the ends of the bristles 16. The presence of scrub solution on the tips of the internal bristles enhances the finger scrubbing and cleaning action of the scrub brush. The perforate transverse structural support or funnel plate is provided with a plurality of membrane puncture elements defining puncture blades or points 44 which are exposed to a membrane 46 that serves as a partition to isolate the scrub solution 48 from the interior of the tubular body until the scrub solution is needed. A soft and flexible cap member 50, preferably in the form of a flexible dome and typically composed of a soft and flexible plastic material is secured to the outer periphery of the funnel plate or to the upper end of the tubular body 12 and, together with the membrane 46, defines a scrub solution chamber within which is located a quantity of scrub solution 48. The scrub solution may simply be a finger cleaning solution or may include a sterilizing agent to facilitate efficient use of the brush as a clinical scrub brush in the surgical theater. To expel the scrub solution through the funnel plate and into the interior 28 of the tubular body the user will simply apply sufficient manual force to the domed shaped end cap 50 to deform it and thus through hydraulic action increase the pressure of the liquid scrub solution to develop sufficient fluid induced force on the membrane 46 to urge the membrane against the membrane puncture points 44 with sufficient force to perforate the membrane. When this occurs, the membrane will be perforated thus allowing the scrub solution to pass through the perforate funnel plate and downwardly through the funnel and into the internal chamber 28 where it flows downwardly essentially along the center line 20 and efficiently coats the tips of the internal bristles 16 with the scrub solution. By then inserting a finger or thumb or other object into the internal chamber 28 and by rotating the tubular body and/or moving the tubular body linearly relative to the finger or thumb, the finger or thumb will receive a scrubbing action in the presence of the scrub solution so that the skin tissue of the user is subjected to the cleaning as well as any anti-bacterial characteristics of the scrub solution.

The internal bristles and scrub solution also enables efficient cleaning and sterilization of the fingernails and cuticles of the user. The crevices in the skin defined by the webs between the fingers and the web between the thumb and finger of the user can be efficiently cleaned simply by rotating the tubular body with the circular array of bristles 27 in contact with the skin tissue.

The external bristles 34 may be in a single linear array as shown in full line or may be mounted in two or more angularly oriented linear arrays as shown at 52 and 54 in FIG. 3. The linear arrays of bristles 34, 52, and 54 are efficient for cleaning beneath the fingernails and about the cuticles of the fingers of the user such as during surgical scrubbing.

Figure 4:
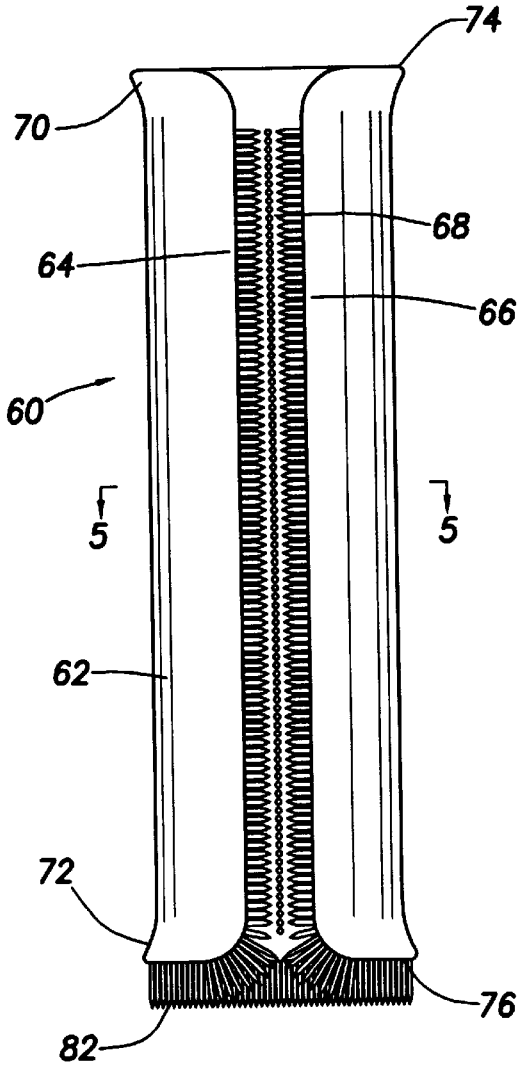

Referring now to FIGS. 4 and 5 a scrub brush element is shown generally at 60 having an elongated, generally tubular body 62 which, again, may be composed of any suitable polymer material or may take the form of a metal or hard rubber structure depending upon the needs and desires of the user. The generally tubular body 62 may be of essentially circular cross-sectional configuration as shown in FIG. 5 and may have slightly flared side elements 64 and 66 that may define an elongate slot 68 that extends at least partially, and preferably entirely, along the length of the tubular body to facilitate cleaning of the brush. Respective end portions 70 and 72 of the tubular body may be outwardly flared as shown to thereby define the circular ends 74 and 76 of greater circular dimension as compared with the circular dimension of the tubular body. When used, the brush is placed on a finger or thumb of a user and is rotated on the finger or thumb as well as moved linearly to develop a scrubbing action to scrub the skin, the finger nails and the webbing between the fingers. The elongate slot 68 is referred to as a cleaning slot so that a brush cleaning implement may be inserted into the opening 68 and moved back and forth for the purpose of cleaning the internal bristles of the tubular body. A multiplicity of internal bristles 78 are located within the tubular body and are fixed to the inner peripheral wall surface structure 80 by any suitable means. The free ends of the bristles 78 substantially meet along the center line of the tubular body as is generally shown in FIG. 5.

As shown at the lower end of FIG. 4 a circular array of bristles 82 is mounted to the circular end 76 of the body. This array of bristles includes angulated bristles that are oriented essentially as shown at the open end of the brush structure of FIG. 1 and identified at 24. The tubular body 62 may also be provided with a bristle mount pad or boss 84 to which is mounted a linear array of bristles 86 which extends along at least some, and preferably substantially the entire length, of the tubular body 62. The external bristle array 86 is used such as for cleaning of the fingernails as well as the fingers of the user in similar manner as described above. The tubular body 62 will be grasped as a handle while the bristles 86 will be moved back and forth to scrub any desired surface of the fingers or hands. The internal bristles 78 will provide a scrubbing action against all of the external surfaces of the users fingers or any other object that is inserted into the internal chamber or receptacle 79 that is defined by the internal surface 80 of the tubular body.

The brush construction shown in FIGS. 4 and 5 while designed particularly for surgical scrubbing activities, will also find wide use in kitchens, bathrooms and other such facilities as well as having industrial cleaning applications such as for cleaning the fingers and the webbing between the fingers of workers such as automotive repair personnel. In the industrial or domestic environment the interior of the tubular brush may be filled with a viscous cleaning compound such as is typically used by automotive repair personnel.

In view of the foregoing it is evident that the present invention is one well adapted to attain all of the objects and features herein above set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A clinical scrub brush device, comprising:

(a) an elongate tubular body defining first and second ends and having an inner peripheral wall surface defining an internal chamber and defining a finger opening at said first end thereof;

(b) a multiplicity of internal bristles being fixed to said inner peripheral wall surface and projecting radially inwardly into said internal chamber;

(c) a perforate structural member being located at said second end of said elongate tubular body and defining at least one puncture element; and (d) a scrub solution housing defining a scrub solution chamber containing a quantity of liquid scrub solution and being supported by said elongate tubular body, said scrub solution housing having a movable wall and having a membrane wall preventing communication of said scrub solution into said internal chamber, said membrane being punctured when forced against said at least one puncture element by scrub solution pressure upon manual movement of said movable wall for releasing said scrub solution from said scrub solution chamber into said internal chamber.

2. The clinical scrub brush device of claim 1, comprising:

said at least one puncture element being a plurality of puncture elements projecting from said perforate structural member and being positioned for perforating contact with said membrane.

3. The clinical scrub brush device of claim 1, comprising:

said movable wall of said scrub solution housing being a flexible wall being yieldable upon application of manually applied force thereto.

4. The clinical scrub brush device of claim 1, comprising:

said movable wall of said scrub solution housing being a flexible wall of domed shaped configuration and being composed of a soft, yieldable polymer material and being yieldable upon application of manual force thereto for increasing the pressure of said scrub solution and developing desired pressure induced force on said membrane for puncture thereof by said at least one puncture element.

5. The clinical scrub brush device of claim 1, comprising:

a funnel element projecting from said structural support member and being disposed to conduct scrub solution to a location centrally and at one end of said internal chamber when said scrub solution is released from said scrub solution chamber through said membrane upon puncture of said membrane.

6. The clinical scrub brush device of claim 1, comprising:

a multiplicity of angulated internal bristles projecting radially from said internal peripheral wall surface at a location adjacent said finger opening and extending generally toward said finger opening.

7. The clinical scrub brush device of claim 1, comprising:

(a) said first end of said elongate tubular body being of flared configuration and defining an outwardly flared internal surface section; and (b) a multiplicity of angulated internal bristles projecting radially from said outwardly flared internal surface section of said internal peripheral wall surface at a location adjacent said finger opening and extending generally toward said finger opening.

8. The clinical scrub brush device of claim 1, comprising:

a multiplicity of external bristles projecting outwardly from said elongate tubular body and forming an external brush located along the length of said elongate tubular body and having a width being less than the outer peripheral dimension of said elongate tubular body.

9. The clinical scrub brush device of claim 1, comprising:

(a) an elongate bristle mount pad being defined by said elongate tubular body and projecting outwardly therefrom; and (b) an external brush array being mounted to said elongate bristle mount pad and having bristles projecting outwardly therefrom.

10. The clinical scrub brush device of claim 1, comprising:

(a) said first end of said elongate tubular body being of flared configuration and defining an outwardly flared internal surface section;

(b) a multiplicity of angulated internal bristles projecting radially from said outwardly flared internal surface section of said internal peripheral wall surface at a location adjacent said finger opening and extending generally toward said finger opening;

(c) an elongate bristle mount pad being defined by said elongate tubular body and projecting outwardly therefrom; and (d) an external brush array being mounted to said elongate bristle mount pad and having bristles projecting outwardly therefrom.

11. A scrub brush device, comprising:

(a) an elongate tubular body defining first and second outwardly flared ends and having an inner peripheral wall surface defining an internal chamber and defining openings at said first and second outwardly flared ends thereof;

(b) a multiplicity of internal bristles being fixed to said inner peripheral wall surface and projecting radially inwardly into said internal chamber; and (c) a multiplicity of angulated internal bristles fixed within at least one of said first and second outwardly flared ends of said elongate tubular body and projecting radially inwardly therefrom, said multiplicity of angulated internal bristles being angularly oriented toward at least one of said first and second outwardly flared end openings.

12. The scrub brush device of claim 11, comprising:

said elongate tubular body defining a longitudinal slot extending along the entire length of said elongate tubular body and exposing said multiplicity of internal bristles to access by objects for cleaning thereof by said multiplicity of internal bristles.

13. The scrub brush device of claim 11, comprising:

a multiplicity of external bristles projecting outwardly from said elongate tubular body and forming an external brush located along the length of said elongate tubular body and having a width being less than the outer peripheral dimension of said elongate tubular body.

14. The scrub brush device of claim 11, comprising:

(a) an elongate bristle mount pad being defined by said elongate tubular body and projecting outwardly therefrom; and (b) an external brush array being mounted to said elongate bristle mount pad and having bristles projecting outwardly therefrom.

15. The scrub brush device of claim 11, comprising:

(a) said first end of said elongate tubular body being of flared configuration and defining an outwardly flared internal surface section;

(b) a multiplicity of angulated internal bristles projecting radially from said outwardly flared internal surface section of said internal peripheral wall surface at a location adjacent said finger opening and extending generally toward said finger opening;

(c) an elongate bristle mount pad being defined by said elongate tubular body and projecting outwardly therefrom; and (d) an external brush array being mounted to said elongate bristle mount pad and having bristles projecting outwardly therefrom.

16. A clinical scrub brush device, comprising:

(a) an elongate tubular body defining first and second ends and having an inner peripheral wall surface defining an internal chamber and defining a finger opening at said first end thereof, said first end being of outwardly flared configuration and defining an outwardly flared internal surface section;

(b) a multiplicity of internal bristles being fixed to said inner peripheral wall surface and projecting radially inwardly into said internal chamber;

(c) a multiplicity of angulated internal bristles projecting radially from said outwardly flared internal surface section of said internal peripheral wall surface at a location adjacent said finger opening and extending generally toward said finger opening;

(d) a perforate structural member being located at said second end of said elongate tubular body and defining at least one puncture element; and (e) a scrub solution housing defining a scrub solution chamber containing a quantity of liquid scrub solution and being supported by said elongate tubular body, said scrub solution housing having a movable wall and having a membrane wall preventing communication of said scrub solution into said internal chamber, said membrane being punctured when forced against said at least one puncture element by scrub solution pressure upon manual movement of said movable wall for releasing said scrub solution from said scrub solution chamber into said internal chamber.

17. The clinical scrub brush of claim 16, comprising:

(a) an elongate bristle mount pad being defined by said elongate tubular body and projecting outwardly therefrom; and (b) an external brush array being mounted to said elongate bristle mount pad and having bristles projecting outwardly therefrom.

* * * * *